United States Patent [19]

Wheatley, Jr.

[11] 4,103,219

[45] Jul. 25, 1978

[54] SHUNT VOLTAGE REGULATOR

[75] Inventor: Carl Franklin Wheatley, Jr., Somerset, N.J.

[73] Assignee: RCA Corporation, New York, N.Y.

[21] Appl. No.: 729,765

[22] Filed: Oct. 5, 1976

[51] Int. Cl.[2] ..... G05F 1/60

[52] U.S. Cl. ..... 323/8; 323/19

[58] Field of Search ..... 323/1, 4, 8, 19, 22 T; 330/17, 22, 23, 25, 300, 40, 252, 261, 297

[56] References Cited

U.S. PATENT DOCUMENTS

| | | | |
|---|---|---|---|
| 3,535,613 | 10/1970 | Katzenstein | 323/8 |
| 3,648,153 | 3/1972 | Graf | 323/19 X |
| 3,781,699 | 12/1973 | Sakamoto | 330/22 X |
| 3,851,241 | 11/1974 | Wheatley | 323/8 |
| 3,962,592 | 6/1976 | Thommen et al. | 330/22 X |
| 4,016,480 | 4/1977 | Hofmann | 323/8 |
| 4,021,722 | 3/1977 | Crowle | 323/4 |
| 4,032,839 | 6/1977 | Ahmed | 323/19 |
| 4,058,760 | 11/1977 | Ahmed | 323/22 T |
| 4,059,793 | 11/1977 | Ahmed | 323/22 T |

OTHER PUBLICATIONS

RCA Transistor, Thyristor & Diode Manual, Technical Series SC-15, Apr. 1971, pp. 234, 235.

*Primary Examiner*—A. D. Pellinen
*Attorney, Agent, or Firm*—H. Christoffersen; Samuel Cohen; Allen LeRoy Limberg

[57] ABSTRACT

An improvement for lowering the source impedance exhibited by a shunt voltage regulator of the type including a self-biased transistor connected between the output terminals. A sensing resistance is connected between the base and collector of the self-biased transistor for providing a voltage responsive to the collector current that controls the conduction of current by a controllable current conductive device between the output terminals.

16 Claims, 1 Drawing Figure

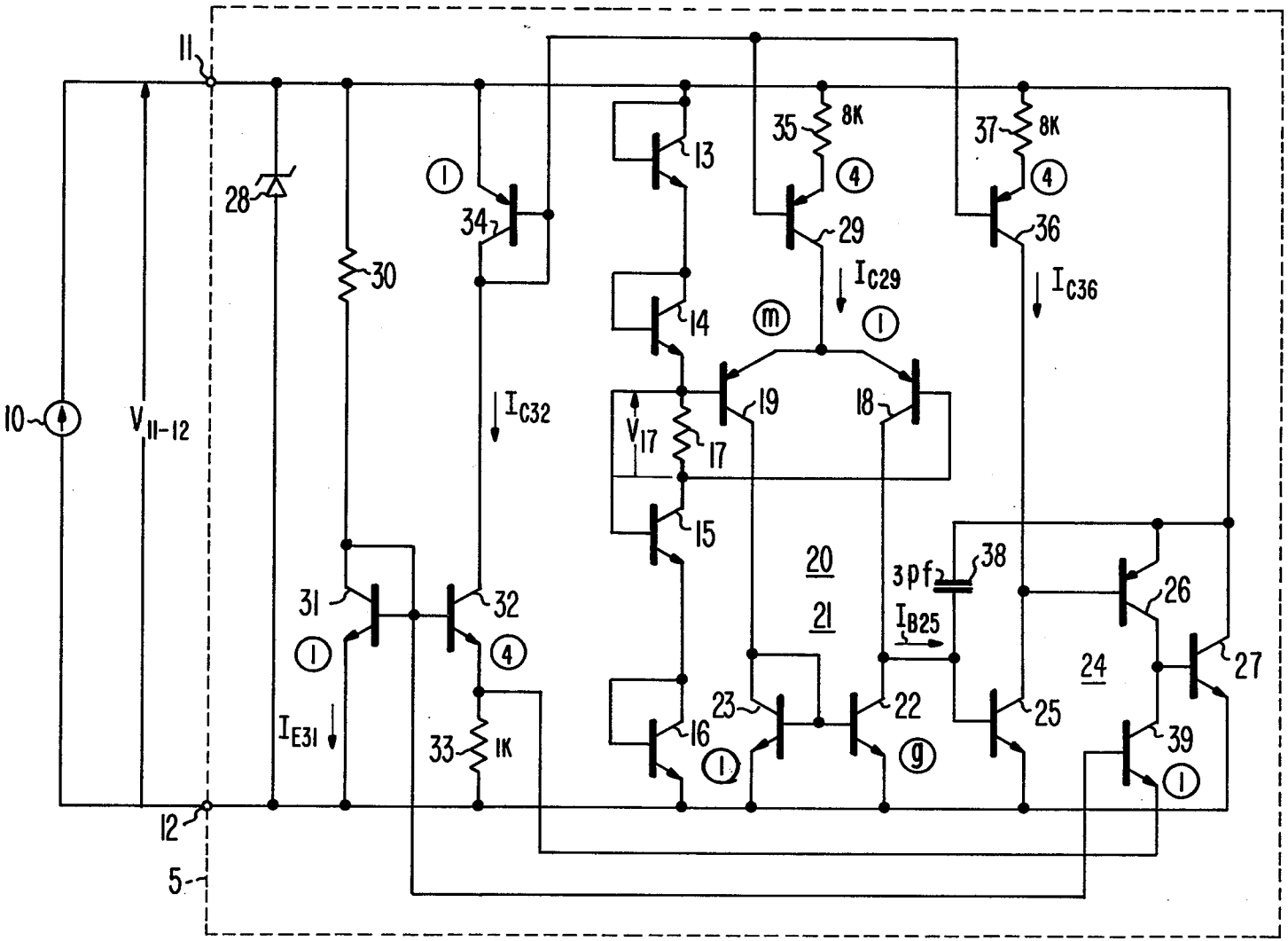
27
26
39
24
25
38
3pf
$I_{B25}$
22
23
20
21
18
19
17
$V_{17}$
13
14
15
16
8K
36
37
$I_{C36}$
8K
29
35
$I_{C29}$
34
$I_{C32}$
32
33
1K
30
31
$I_{E31}$
28
11
12
5
$V_{11-12}$
10

SHUNT VOLTAGE REGULATOR

The present invention relates to an improved shunt regulator and, more particularly, to one which exhibits a relatively low source impedance.

Diode means are included in a connection between the output terminals of the regulator for controlling or aiding in controlling the potential between these terminals. Current flow in the diode means is sensed in a way that does not affect its offet potential and is used to control the conduction of current by a controllable current conductive device between the output terminals. The major portion of the task of providing shunt regulation of the potential between the output terminals is performed by the controllable current conductive means. This lessens the variation in current flow through the diode means so its offset potential (and the offset potential of any other potential-offsetting element associated therewith) remains more constant.

The sole FIGURE is a schematic diagram of a multiple-$V_{BE}$ supply embodying the present invention.

The base-emitter offset potential $V_{BE}$ of a transistor has the following well-known relationship to its collector current $I_C$.

$$V_{BE} = (kT/q)\ln(I_C/I_S) \quad (1)$$

where p1 *k* i Boltzmann's constant;

T is the absolute temperature at which the transistor is operated;

*q* is the charge on an electron; and $I_S$ is the value of $I_C$ for $V_{BE} = 0$. In the explanation below, $V_{BE}$, $I_C$ and $I_S$ are subscripted with the identification numerals of the transistors with which each is associated.

In the present circuit, the transistor operate at substantially the same temperatures T--owing, for example, to monolithic integrated circuit construction. $V_{BE}$ is a weak function of $I_C$ variation, changing in a silicon transistor, only 18 millivolts or so with each doubling of $I_C$. However, in voltage supplies used to bias transistors not provided emitter degeneration resistances, it is often desirable to provide a multiple of $V_{BE}$ potential that is an exact multiple of the particular value of $V_{BE}$ associated with a particular $I_C$ level.

In the FIGURE, current source 10 applies current between output terminals 11 and 12 of a monolithic integrated circuit 5. It is between terminals 11 and 12 that a desired regulated potential $V_{11\text{-}12}$ is to be maintained. Diode 28 protects the remainder of the elements in the voltage regulator shown in the drawing, supposing it to be constructed in monolithic integrated circuit form, from source 10 being applied in erroneous polarity and from fast rising transients. Current flows through the series connection of resistor 30 and self-biased transistor 31, causing an emitter current $I_{E31}$ in transistor 31 which is substantially equal to ($V_{11\text{-}12}$—$V_{BE}$) divided by the resistance of resistor 30. Transistor 31 is in current mirror amplifier connection with transistor 39, causing transistor 39 to demand a collector current $I_{C39}$ used to pull down the base electrode of a shunt-regulator transistor 27 whenever the conduction of transistor 26 is reduced. Elements 31–32 operate as a current amplifier with logarithmic response, so the collector current $I_{C32}$ of transistor 32 exhibits reduced variation as compared to $I_{E31}$. Elements 34, 29, and 35–36 operate as a dual-output current amplifier with its equal output currents $I_{C29}$ and $I_{C36}$ each provided in logarithmic response to $I_{C32}$. $I_{C29}$ and $I_{C36}$ as a result of the cascade logarithm-taking are essentially constant with temperature despite the variation in $V_{11\text{-}12}$ with temperature.

Terminals 11 and 12 are at the ends of a string of self-biased transistors 13, 14, 15 and 16. The regulatory properties of these self-biased transistors would, without further circuitry, tend to hold the potential $V_{11\text{-}12}$ between terminals 11 and 12 at a $4V_{BE}$ level. However, suppose the current applied to the string varies, due, for example, to variation in the source 10 current and/or to variations in the load between terminals 11 and 12. Then, the $4V_{BE}$ level would vary somewhat; that is, the source impedance appearing between output terminals 11 and 12 would be larger than desired.

However, in the FIGURE, the current flow through self-biased transistors 13, 14, 15 and 16 is itself regulated by controlling the conduction of a controllable current conductive device, shown as comprising transistor 27 providing a shunt path for current parallelling the series connection of elements 13, 14, 15 and 16. This is done so the combined offset potentials appearing across self-biased transistors 13, 14, 15 and 16 is held much more constant, lowering the source impedance presented between output terminals 11 and 12. To this end, a sensing resistor 17 is included between the base and collector electrodes to transistor 15 to sense its collector current and provide a response voltage $V_{17}$, which in accordance with Ohm's Law, is linearly related to the collector current of transistor 15. $V_{17}$ is applied between the base electrodes of long-tailed pair transistors 18 and 19 to determine how the current $I_{C29}$ supplied to their joined emitter electrodes is divided between the transistors.

Transistors 18 and 19 have effective base-emitter junction areas in 1:m ratio, as indicated by the encircled numbers next to their respective emitters, and have similar base-emitter junction profiles. Equation 2 can be written proceeding from a Kirchoff's Voltage Law observation and then substituting thereinto from Equation 1 to determine the relationship between the respective collector currents $I_{C18}$ and $I_{C19}$ of transistors 18 and 19.

$$V_{17} = V_{BE18} - V_{BE19} = (kT/q)\ln(I_{C18}/I_{S18}) - (kT/q)\ln(I_{C19}/I_{S19}) = (kT/q)[\ln(I_{C18}/I_{C19}) - \ln(I_{S18}/I_{S19})]. \quad (2)$$

Owing to construction by concurrent process steps, transistors 18 and 19 are assumed to have similar base-emitter junction profiles causing their respective saturation currents $I_{S18}$ and $I_{S19}$ to be related in the same ratio as the effective geometries of their respective base-emitter junctions, permitting the following equation to be written.

$$m\, I_{S18} = I_{S19} \quad (3)$$

Equation 4 is obtained by substituting equation 3 into equation 2.

$$I_{C18} = (I_{C19}/m)\exp(q\, V_{17}/kT) \quad (4)$$

$I_{C19}$ is applied to current mirror amplifier (CMA) 21 comprising transistor 22 and 23. Transistors 22 and 23 have base-emitter junctions with similar profiles and with effective areas in g:1 ratio as indicated by the encircled numbers near their respective emitters. So, CMA 21 exhibits a current gain substantially equal to $-g$, and transistor 22 demands a collector current substantially equal to $gI_{C19}$. The base current $I_{B25}$ applied to transistor 25 can be determined by Kirchoff's Current Law to be as follows.

$$I_{B25} = I_{C18} - gI_{C19} \quad (5)$$

Substituting from equation 4 into equation 5, $$I_{B25} = \{[(1/m) \exp (qV_{17}/kT)] - g\} I_{C19} \quad (6)$$

Suppose now at a given temperature T, a particular level $I_{17}$ design of $I_{17}$ is to be maintained flowing through sensing resistor 17. ($I_{17}$ design will, of course, substantially equal the current flowing through self-biased transistors 13, 14, 15 and 16.) Under these conditions, $I_{B25}$ is to be substantially zero-valued and $V_{17}$ is to have a threshold value $V_{17\ threshold}$ determined from equation 6 for this condition.

$$V_{17\ threshold} = (kT/q)\ln(mg) \quad (7)$$

The differential-input, single-ended output amplifier 20 comprising the long-tailed pair 18, 19 and CMA 21 provides a threshold detection means for developing a control signal whenever $V_{17}$ exceeds $V_{17\ threshold}$. The transconductance of amplifier 20 is determined, of course, by the magnitude of the tail current $I_{C29}$ applied to the joined emitter electrodes of long-tailed pair transistors 18 and 19.

The resistance $R_{17}$ of sensing resistor 17 can be determined by Ohm's Law, as follows.

$$R_{17} = V_{17threshold}/I_{17design} = [(kT/q)\ln(mg)]I_{17design} \quad (8)$$

Current substantially in excess of $I_{17design}$ applied between terminals 11 and 12 will, by Ohm's Law, tend to increase $V_{17}$. An increase in $V_{17}$ increases $I_{C18}$ relative to $I_{C19}$ and thus relative to $-gI_{C19}$. So base current is applied to transistor 25 to be amplified several thousand times by a cascade amplifier connection 24 of transistors 25, 26 and 27. This greatly amplified current demand is impressed between terminals 11 and 12 to divert substantially all of the current in excess of $I_{17design}$ to the collector-to-emitter path of transistor 27. In this way, the current flow through self-biased transistors 13, 14, 15 and 16 is maintained substantially constant (and nearly equal to $I_{17design}$) for all values of current supplied by source 10 that exceed $I_{17design}$ by more than a small amount.

The burden of providing shunt regulation between terminals 11 and 12 is shifted in major part from the serially connected self-biased transistors 13, 14, 15 and 16 to the controlled current-conductive device 27. The serially connected self-biased transistors 13, 14, 15 and 16 serve primarily as a means for sensing the voltage appearing between terminals 12 and 11, rather than as the controlled current conduction path for shunt regulation of this voltage. The amount of change in the current supplied from source 10 or change in the loading applied between terminals 12 and 11 to cause a given change in $V_{11\text{-}12}$, as compared to the case where amplifier 27 does not shunt regulate $V_{11\text{-}12}$, is increased by a factor substantially equal to the product of $R_{17}$, the transconductance of amplifier 20, and the common-emitter forward current gains of transistors 25, 26 and 27. This factor, by which the source impedance of the supply is reduced, easily can be made to have a value of a few thousand.

Capacitor 38 is used to control the phase response characteristic of amplifier 24 so as to meet the Nyquist stability criteria in the regulator degenerative feeback loop.

As previously suggested, a number of diode arrangements may replace the serial connection of self-biased transistors 13, 14, 15 and 16. Self-biased transistor 16 may, for example, be replaced by a direct connection between the emitter electrode of transistor 15 and terminal 12. Replacement of self-biased transistors 13 and 14 by means offering a substantially lower offset potential between the base electrode of transistor 15 and terminal 11—e.g. a direct connection therebetween—will require applying operating potentials to several points in the circuit from another source or other sources than that provided between terminals 12 and 11, which changes are easily made by one skilled in the art. This must be done to avoid reduction in operating potentials that would otherwise prevent elements 20, 25, 26, 27, 29, 31, 32, 34 and 36 from exhibiting proper amplification characteristics.

Arrangements in which the self-biased transistor 15 is of similar rather than complementary conductivity type to long-tailed pair transistors 18 and 19 are possible, and other means than CMA 21 may be used for differentially combining the collector currents of transistors 18 and 19. An even number of transistor amplifier stages may replace those transistor amplifier stages including transistors 25, 26 and 27, respectively, with the final stage including a transistor with emitter and collector electrodes connected to terminal 11 and to terminal 12, respectively. A resistor having a resistance proportional to that of sensing resistor 17 may be inserted in series with self-biased transistors 13 and 14 or in series with self-biased transistor 16 to increase $V_{11\text{-}12}$ to simulate operation of transistors 13, 14, 15 and 16 at higher current level. Avalanche diode elements may be included in series with self-biased transistors 13 and 14 or self-biased transistor 16 to provide low-impedance shunt regulation to voltages with different temperature coefficients. One skilled in the art of semiconductor design will be enabled by the teaching of this disclosure to provide many design alternatives to that shown in the FIGURE and the scope of the claims should be accordingly construed.

In the following claims, "diode means" includes within its scope both diodes and self-biased transistors.

What is claimed is:

1. In a shunt regulator having first and second terminals linked by means for determining the potential appearing between them, improved said means for determining the potential appearing between said first and second terminals, including:

a transistor having first and second electrodes and a controlled conduction path therebetween and having a third electrode, the conduction of said controlled conduction path being controlled responsive to potential appearing between the first and third electrodes;

a resistance having first and second ends;

first direct current conductive means connecting the first electrode of said transistor to said first terminal;

second direct current conductive means connecting the second electrode of said transistor to the first end of said resistance;

third direct current conductive means connecting the second end of said resistance to said second terminal;

means providing direct coupling between the second end of said resistance and the third electrode of said transistor; and means responsive to potential drop appearing across said resistance for shunt regulating the current flow through said means for determining the potential appearing between said first and second terminals.

2. An improved shunt regulator as set forth in claim 1 wherein said means for shunt regulating current flow includes:

current amplifying means having an output circuit connected between said first and second terminals and having an input circuit; and means for detecting when the potential drop across said resistance exceeds a predetermined threshold value for applying a current proportional to said excess to said input circuit of said current amplifying means.

3. An improved shunt regulator as set forth in claim 2 wherein said means for detecting when the potential drop across said resistance exceeds a predetermined threshold value includes:

a pair of further transistors of the same conductivity type as each other, each having first and second electrodes with a conduction path therebetween and having a control electrode, the flow of current through said conduction path of each further transistor being responsive to the potential between its control and first electrodes; and means connecting said further transistors in long-tailed pair configuration, their respective control electrodes being connected to opposite ends of said resistance; and means direct coupling the second electrode of at least one of said further transistors to the input circuit of said current amplifying means.

4. An improved shunt voltage regulator of the type including a pair of output terminals with a first current conductive path therebetween, and including a self-biased first transistor connected as a forward-biased diode means in said first current conductive path and operated at an absolute temperature T, said first transistor having base and emitter and collector electrodes, wherein the improvement comprises:

a sensing resistance connected between the base and collector electrode of said self-biased first transistor for sensing the collector current of said first transistor, responsive to which collector current a potential drop appears across said sensing resistor;

threshold detection means for generating a control signal dependent upon the amount by which the potential drop appearing across said sensing resistor exceeds a threshold value linearly relate to the absolute temperature T; and controllable current conductive means connected to provide a second current conduction path between said pair of output terminals, the conduction of said second current path being responsive to said control signal for shunt regulating the portion of any current applied between said pair of output terminals that flows through said self-biased first transistor.

5. An improved shunt voltage regulator as set forth in claim 4 wherein said self-biased first transistor is serially connected with at least one other diode means between said pair of output terminals for providing said first current conductive path.

6. An improved shunt voltage regulator as set forth in claim 4 wherein said threshold detection means comprises:

second and third transistors in long-tailed pair configuration, having respective base electrodes connected to opposite ends of said sensing resistor, having respective emitter electrodes with an interconnection therebetween and having respective collector electrodes;

means for causing tail current flow to the interconnection between the emitter electrodes of said second and said third transistors; and a current amplifier having input and output terminals between which a predetermined current gain is exhibited, each of said current amplifier input and output terminals having a respective one of the collector electrode of said second and said third transistor galvanically connected to it, said current amplifier for combining the collector currents of said second and said third transistors flowing responsive to said tail current and the potential drop appearing across said sensing resistor thereby to provide at the current amplifier output terminal a current corresponding to said control signal.

7. An improved shunt voltage regulator as set forth in claim 6 wherein said controllable current conductive means comprises:

a fourth transistor having emitter and collector electrodes connected to separate ones of said pair of regulator output terminals and having a base electrode; and means direct coupling said current amplifier output terminal to the base electrode of said fourth transistor.

8. An improved shunt voltage regulator as set forth in claim 7, said means direct coupling said current amplifier output terminal to the base electrode of said fourth transistor includes at least one transistor amplifier stage.

9. A voltage reference circuit comprising:

first and second terminals between which reference voltage is to appear in response to applied current;

a first transistor being operated at a temperature T having a base electrode connected to said first terminal so as to respond to the potential at said first terminal, having an emitter electrode connected to said second terminal, and having a collector electrode;

a resistance connected between the base and collector electrodes of said first transistor for developing a potential drop across itself responsive to the collector current of said first transistor flowing in response to said applied current;

means responsive to the potential drop across said resistance being in excess of a threshold potential to provide an error signal directly related to said excess; and means responsive to said error signal for shunt regulating the portion of said applied current flowing through said transistor.

10. A voltage reference circuit as claimed in claim 9 wherein said means to provide an error signal comprises:

second and third transistors of the same conductivity type as each other, being operated at substantially the same temperature T as said first transistor, having respective base electrodes between which said resistance is connected, having respective emitter electrodes joined at an interconnection, and having respective collector electrodes;

a first current amplifier having input and common and output terminals, the collector electrode of said second transistor being connected to the input terminal of said first current amplifier, and the collector electrode of said third transistor and the output terminal of said first current amplifier being connected to a circuit node at which said error signal obtains; and a source of current, connected between the common terminal of said first current amplifier and the interconnection at which the emitter electrodes of said second and said third transistors join.

11. A voltage reference circuit as claimed in claim 9 wherein said means for shunt regulating comprises:

a second current amplifier having an input terminal connected to said circuit node at which said error signal obtains, and having output and common nodes connected to separate ones of said first and said second terminals to complete a degenerative feeback loop.

12. A voltage reference circuit as claimed in claim 9 wherein the base electrode of said first transistor is connected to said first terminal via a conduction path through at least one further, self-biased transistor.

13. A voltage reference circuit as claimed in claim 9 wherein the emitter electroe of said second transistor is connected to said second terminal via a conduction path through at least one further, self-biased transistor.

14. An amplifier comprising:

first and second circuit nodes for connection to a source of unidirectional input current as may be subject to variation;

a first transistor having base and emitter electrodes with an emitter-base junction therebetween connected respectively to said first circuit node and to said second circuit node, having a collector electrode, and being of a conductivity type such that the portion of said unidirectional input current flowing to the emitter-base junction of said first transistor forward biases that emitter-base junction;

a resistive element having a first end connected to said first circuit node and having a second end to which the collector electrode of said first transistor connects;

second and third transistors of the same conductivity type as each other, each of said second and third transistors having respective base and emitter electrodes and an emitter-base junction therebetween and having a respective collector electrode, their respective base electrodes being connected to separate ones of the first and second ends of said resistive element, each of said second and third transistors being operated at substantially the same absolute temperature as said first transistor; and means connecting said second and third transistors is long-tailed pair configuration including a source of tail current applied to an interconnection without substantial intervening elements between the emitter electrodes of said first and second transistors to supply quiescent forward bias to their respective emitter electrodes, and means for deriving output signal current variations proportionally responsive to said input current signal current variations from at least one of the collector electrodes of said second and third transistors.

15. An amplifier as set forth in claim 18 wherein said means for deriving output signal current variations from at least one of the collector electrodes of said second and third transistors includes a current mirror amplifier having an input terminal to which the collector electrode of said second transistor connects, having an output terminal, and exhibiting a current gain of $-g$ between its input and output terminals, $g$ being a positive number; and a third conduit node to which the collector electrode of said third transistor and the output terminal of said current mirror amplifier connect, at which third circuit node said output signal current variations are available.

16. An amplifier as set forth in claim 15 including:

means responsive to said output signal variations for shunt regulating the current flow between said first and second circuit nodes.

* * * * *

UNITED STATES PATENT AND TRADEMARK OFFICE
CERTIFICATE OF CORRECTION

PATENT NO. : 4,103,219

DATED : July 25, 1978

INVENTOR(S) : Carl Franklin Wheatley, Jr.

It is certified that error appears in the above-identified patent and that said Letters Patent is hereby corrected as shown below:

Col. 1, line 28, after "where" delete --pl--
" " line 28, "i" should be --is--
" " line 36, "transistor" should be --transistors--
Col. 2, line 11, "variation" should be --variations--
" " line 65, "transistor" should be --transistors--
Col. 4, line 3, "feeback" should be --feedback--
Col. 5, line 49, "electrode" should be --electrodes--
" " line 56, "relate" should be -- related --.
Col. 6, line 19, "electrode" should be --electrodes--
Col. 7, line 23, "feeback" should be --feedback--
" " line 29, "electroe" should be --electrode--
Col. 8, line 13, "is" should be --in--
" " line 25, "18" should be --14--
" " line 35, "conduit" should be --circuit--

Signed and Sealed this

*Twenty-third* Day of *January 1979*

[SEAL]

*Attest:*

RUTH C. MASON
*Attesting Officer*

DONALD W. BANNER
*Commissioner of Patents and Trademarks*